United States Patent [19]

Gragson

[11] 4,261,841

[45] Apr. 14, 1981

[54] LUBRICATING COMPOSITION COMPRISING HYDROGENATED OLIGOMERS OF 1,3-DIOLEFINS AND A CALCIUM PETROLEUM SULFONATE

[75] Inventor: James T. Gragson, Bartlesville, Okla.

[73] Assignee: Phillips Petroleum Company, Bartlesville, Okla.

[21] Appl. No.: 105,042

[22] Filed: Dec. 18, 1979

[51] Int. Cl.[3] ..... C10M 3/34; C10M 3/12

[52] U.S. Cl. ..... 252/33; 585/3; 585/10; 585/12

[58] Field of Search ..... 252/33; 585/3, 10, 12

[56] References Cited

U.S. PATENT DOCUMENTS

| | | | |
|---|---|---|---|
| 2,308,116 | 1/1943 | Silverman | 252/33.2 |
| 2,423,789 | 7/1947 | Murphy et al. | 252/32.7 R |
| 2,856,361 | 10/1958 | Schlicht | 252/33 |
| 2,884,445 | 4/1959 | Axe et al. | 260/504 A |
| 2,909,563 | 10/1959 | Whitney | 260/504 R |
| 3,223,630 | 12/1965 | Gragson | 252/25 |
| 3,480,550 | 11/1969 | Henderson et al. | 252/33 |
| 3,523,897 | 8/1970 | De Vault | 252/33 |
| 3,537,996 | 11/1970 | Holst et al. | 252/33 |
| 3,562,159 | 2/1971 | Mastin | 252/32.7 |
| 3,712,864 | 1/1973 | Loeffler et al. | 585/3 |
| 3,725,279 | 4/1973 | Armstrong | 585/3 |
| 3,762,888 | 10/1973 | Kober et al. | 585/3 |
| 3,801,508 | 4/1974 | Meier et al. | 585/10 |
| 3,852,204 | 12/1974 | Souillard et al. | 252/33.4 |
| 3,965,017 | 6/1976 | Burnop et al. | 252/33.4 |
| 3,965,019 | 6/1976 | St. Clair et al. | 585/11 |
| 4,060,492 | 11/1977 | Yasui et al. | 260/676 |
| 4,073,737 | 2/1978 | Elliott | 585/3 |
| 4,158,633 | 6/1979 | Papay | 252/33 |
| 4,165,291 | 8/1979 | Gragson | 252/33 |
| 4,175,046 | 11/1979 | Coant et al. | 585/3 |
| 4,175,047 | 11/1979 | Schick et al. | 585/3 |
| 4,179,389 | 12/1979 | Mann | 252/33 |

FOREIGN PATENT DOCUMENTS

| | | | |
|---|---|---|---|
| 1002721 | 8/1965 | United Kingdom | 585/12 |

*Primary Examiner*—Delbert E. Gantz
*Assistant Examiner*—Irving Vaughn
*Attorney, Agent, or Firm*—Paul L. Gomory

[57] ABSTRACT

A lubricating composition comprising a hydrogenated oligomer of a 1,3-diolefin, e.g., 1,3-butadiene, and a calcium petroleum sulfonate which can be at least one of a substantially neutral calcium petroleum sulfonate and an overbased calcium petroleum sulfonate is disclosed. The incorporation of the calcium petroleum sulfonate yields a composition having an unexpectedly, considerably lower pour point than that possessed by the hydrogenated oligomer alone.

7 Claims, No Drawings

LUBRICATING COMPOSITION COMPRISING HYDROGENATED OLIGOMERS OF 1,3-DIOLEFINS AND A CALCIUM PETROLEUM SULFONATE

BRIEF SUMMARY OF THE INVENTION

Lubricating compositions are prepared from hydrogenated oligomers of 1,3-diolefins and at least one of a neutral and an overbased calcium petroleum sulfonate. Unexpectedly low pour points compared with similar compositions not containing the sulfonate are obtained.

DETAILED DESCRIPTION

This invention relates to the production of a lubricating composition. In one of its aspects it relates to a synthetic lubricating oil containing composition. More specifically it relates to a synthetic lubricating oil composition comprising a hydrogenated oligomer of a 1,3-diolefin.

In one of its concepts the invention provides a composition comprising a hydrogenated oligomer of 1,3-diolefin and at least one of a neutral and an overbased calcium petroleum sulfonate. In another of its concepts the invention provides a compounded synthetic lubricating oil composition primarily and importantly containing a hydrogenated oilgomer as herein described and a calcium petroleum sulfonate also as herein described.

I have now discovered that in compounding a hydrogenated oligomer of a 1,3-diolefin, e.g., an oligomer of 1,3-butadiene, with at least one of a neutral and an overbased calcium petroleum sulfonate that there is obtained, quite unexpectedly, a marked lowering of pour point compared with composition similarly compounded but without calcium petroleum sulfonate.

It is an object of this invention to provide a synthetic lubricating oil composition. It is another object of this invention to prepare a synthetic lubricating oil composition having a considerably lowered pour point. It is a further object of the invention to compound a hydrogenated oligomer of a 1,3-diolefin with an agent which will yield a composition having a pour point considerably lower than that of the hydrogenated oligomer in the absence of such an agent.

Other aspects, concepts, objects, and several advantages of the invention are apparent from the study of this disclosure and the appended claims.

According to the present invention there is provided an improved synthetic lubricating oil which comprises incorporating together a synthetic lubricating oil stock material essentially consisting of a hydrogenated oligomer of a 1,3-diolefin and at least one of a neutral and an overbased calcium petroleum sulfonate.

The hydrogenated diolefin oligomers serving as the synthetic lubricating oil base for the composition of the present invention are prepared from 1,3-dienes generally having from 4 to 8 carbon atoms per molecule and mixtures thereof. Examples of suitable monomers include 1,3-butadiene, piperylene, isoprene, 1,3-hexadiene, 1,3-octadiene, and the like.

The useful oligomers will generally contain from 12 to 50, and preferably, 20 to 40 carbon atoms in the oligomer.

Oligomers useful in preparing the base synthetic lubricating oil for use in this invention are readily prepared by any of the processes known in the art. Cobalt compounds reduced with an organic aluminum compound can be employed as the oligomerization catalyst. Suitable cobalt compounds include the salts of carboxylic acids, such as cobalt formate, cobalt acetate, cobalt propionate, cobalt oxalate, cobalt citrate, cobalt hexanoate, cobalt naphthenate, and the like. They can also be inorganic salts, such as cobalt chloride, cobalt bromide, and cobalt iodide. Certain complexes containing cobalt, such as cobalt(III) acetylacetonate, cobalt(II) acetylacetonate, dicobalt octacarbonyl, and the like are likewise of use in preparing the oligomers of the present invention.

Compounds suitable for reducing the above-mentioned cobalt compounds include the known aluminum alkyls, such as trialkyl aluminum, dialkyl aluminum chloride, alkyl aluminum sesquichloride, and the like in which alkyl groups generally contain from 1 to 5 carbon atoms.

Reaction conditions and component ratios given in British Pat. No. 1,002,721 are generally suitable for use in preparing the oligomers for use in this invention.

Hydrogenation of the above-described oligomers to produce the synthetic lubricating oil stock useful in this invention can be carried out by a process known in the art. Cobalt compounds, such as those described above, reduced with organic aluminum compounds, such as those described above, result in well known hydrogenation catalysts which are suitable for use in this invention. Other known catalyst systems and hydrogenation processes are within the scope of this invention.

Hydrogenation conditions which result in hydrogenated oligomer containing less than about 10 percent, and preferably less than about 5 percent, residual olefinic unsaturation are suitable for preparing the synthetic lubricating oil stock of this invention.

The calcium petroleum sulfonate mixtures useful in admixing with the above-described hydrogenated diene oligomers to produce the lubricating compositions of this invention which exhibit lower pour point than the synthetic lubricating oil base stocks are selected from substantially neutral calcium petroleum sulfonate mixtures or, preferably from those calcium petroleum sulfonate mixtures referred to in the art as "overbased". The substantially neutral calcium petroleum sulfonate mixtures are generally prepared by neutralization with lime of a sulfonated, high molecular weight, highly refined, lubricating oil stock and the subsequent removal of any remaining suspended solid material by filtration. These substantially neutral calcium petroleum sulfonate mixtures can be readily prepared by means well known in the art, such as those disclosed in U. S. Pat. Nos. 2,884,445, and 2,909,563.

Petroleum sulfonic acid which is neutralized to form petroleum sulfonates normally includes appreciable amounts of various hydrocarbons not having the sulfonic acid group so that when the sulfonate is formed, the resulting product is a mixture of unsulfonated hydrocarbons and sulfonates. Herein the mixture containing both unsulfonated hydrocarbons and sulfonates which results from neutralization of petroleum sulfonic acid with calcium oxide and/or hydroxide is referred to as "calcium petroleum sulfonate mixture". Likewise overbasing of a calcium petroleum sulfonate mixture results in a mixture comprising calcium petroleum sulfonate, unsulfonated hydrocarbon, basic material (especially calcium carbonate and calcium hydroxide) and diluent oils added for the overbasing operation. Herein the mixture resulting from overbasing of a calcium petroleum sulfonate mixture is referred to as "overbased calcium petroleum sulfonate mixture".

Overbased calcium petroleum sulfonate mixtures are well known in the art. Total base numbers (TBN) of such "superbasic" calcium petroleum sulfonate mixtures can be varied over wide ranges, such as 50 to 400. U.S. Pat. Nos. 3,523,897 and 3,223,630 are exemplary of those disclosures available in the art giving processes for preparing overbased calcium petroleum sulfonate mixtures. It is currently preferable to employ overbased calcium petroleum sulfonate mixtures with total base numbers in the range of 200 to 350 in the lubricating compositions of this invention. In preparing overbased calcium petroleum sulfonate mixtures of the preferred TBN, it is desirable to employ a monoalkylbenzene, such as toluene, as solvent for the overbasing operation, to be used either as the sole solvent or in combination with another solvent, such as petroleum naphtha. The use of monoalkylbenzene as solvent frequently results in higher TBN than attainable with, e.g., only naphtha as solvent. The use of a monoalkylbenzene solvent, as here disclosed, is disclosed and claimed in U.S. Pat. No. 4,165,291 issued Apr. 11, 1979, James T. Gragson. It is ordinarily desirable to employ diluent oils in the overbasing operation. Thus from about 0.2 to about 5, and preferably from about 0.5 to about 2, parts by weight diluent oil per part by weight of calcium petroleum sulfonate mixture can be employed in the overbasing operation. Suitable diluent oils include refined lubricating oil fractions of about 50 to 300 SUS viscosity at 37.5° C. and preferably 75 to 125 SUS viscosity.

Alkaline reserve can be measured by total base number (TBN) which is the number of milligrams of potassium hydroxide equivalent to the amount of acid required to neutralize the alkaline constituents present in one gram of sample.

Calcium petroleum sulfonate mixtures and overbased calcium petroleum sulfonate mixtures are employed in the inventive lubricating formulations in amounts ranging from about 0.1 to about 5 weight percent, and preferably from about 0.25 to about 2 weight percent, based on the total lubricating formulation. Thus it will be recognized that the amount of actual calcium petroleum sulfonate and/or basic material (esp., calcium carbonate and calcium hydroxide) employed in the inventive lubricating formulations will be dependent upon the amount of unsulfonated hydrocarbon oil and diluent oil in the calcium petroleum sulfonate mixture and the overbased calcium petroleum sulfonate mixture. Calcium petroleum sulfonate mixtures prepared according to well-known procedures, such as described above, usually contain from 40 to 60 percent by weight and more usually about 50 percent by weight of unsulfonated oil. Overbased calcium petroleum sulfonate mixtures which optionally contain diluent oil as described above thus contain from about 40 to 95 percent by weight, and preferably about 50 to 85 percent by weight unsulfonated oil and diluent oil (based on total calcium petroleum sulfonate mixture and diluent oil).

In addition to the above-described synthetic lubricating oil base and calcium petroleum sulfonate mixture or overbased calcium petroleum sulfonate mixture, the lubricating compositions of this invention can contain any of the known ingredients of lubricating compositions including viscosity index improvers, detergents, dispersants, antioxidants, and antiwear additives. These ingredients can be added to the inventive lubricating compositions to tailor the properties of the resulting composition to meet any specific needs. It is within the scope of the invention to add to the lubricating formulations minor amounts, e.g., less than fifty percent by weight of total formulation and preferably less than ten percent by weight, of an added diluent oil generally comprising a naturally occurring, refined lubricating oil fraction of a viscosity suitable to produce a final lubricating formulation with desired properties. Refined lubricating oil fractions of about 50 to 300 SUS viscosity at 37.5° C., and preferably 75 to 125 SUS viscosity, are suitable for use as added diluent oil with the synthetic lubricating oil-based formulations of this invention.

EXAMPLE I

The following inventive and comparative runs demonstrate the use of an overbased calcium petroleum sulfonate mixture and a substantially neutral calcium petroleum sulfonate mixture as pour point depressants for synthetic lubricating oils consisting essentially of hydrogenated oligomers of 1,3-butadiene.

The calcium petroleum sulfonate mixture was prepared according to the following procedure. The oil which was sulfonated was a propane-fractionated, phenol-extracted and dewaxed Mid-Continent lubricating oil fraction of about 203 SUS viscosity at 99° C. and a viscosity index of about 93. This charge stock was sulfonated with a solution of about 10 weight percent $SO_3$ in liquid $SO_2$ at 43° C. for about 10 minutes. The $SO_3$ to oil weight ratio was about 0.08 to 1. The sulfonation effluent was flashed to remove $SO_2$, leaving a solution of about 48 weight percent petroleum sulfonic acid in unsulfonated oil. This mixture was then diluted with naphtha and neutralized by addition of an aqueous slurry of calcium hydroxide more than chemically equivalent to the sulfonic acid present. This mixture was stabilized by heating, followed by drying in a flash tower. The product recovered at this point is termed "dryer tower bottoms" and contained 19–20 weight percent each of calcium petroleum sulfonate and unsulfonated oil, about 0.76 weight percent calcium hydroxide, about 0.24 weight percent water, less than one weight percent each of calcium sulfate and calcium sulfite, and the remainder being naphtha. The dryer tower bottoms were diluted with additional naphtha and filtered to remove solids. The naphtha was then removed to produce a substantially neutral calcium petroleum sulfonate mixture which was substantially 50 weight percent calcium petroleum sulfonate and 50 weight percent unsulfonated oil and exhibited a total base number of about 7.5.

A mixture comprising proportions of 454 g of the above-described calcium petroleum sulfonate mixture, 454 g of propane-fractionated Mid-Continent lubricating oil fraction of about 96–98 SUS viscosity at 37.5° C. and a viscosity index of about 95, 1.8 kg toluene, 136 g methanol and 544 g hydrated lime was mixed and passed into the top of a vertical column 5.1 cm diameter with a 3.1 m column of liquid maintained therein and a temperature of 38°–57° C. Carbon dioxide (0.6 mol per mol of lime) was introduced at the bottom of the column and allowed to bubble upward through the feed. Flow rate of feed was adjusted to allow 22 minute residence time. The resulting mixture was heated at 110° C. to expel methanol and water, was filtered to remove solids and was stripped of solvent. The resulting overbased calcium petroleum sulfonate mixture exhibited a total base number of 313.

Synthetic lubricating oil A employed in following runs 1–4 was prepared by oligomerization of 1,3-butadiene in the presence of cobalt octanoate reduced with triethylaluminum as catalyst and toluene as solvent followed by a preliminary treatment of the reaction mixture with hydrogen. The reaction mixture was then washed with acetic acid solution, water, sodium hydroxide solution and water. Drying over molecular sieve followed by fractional distillation gave a fraction boiling at 400°–555° C. (corrected to atmospheric pressure). Further hydrogenation of that fraction over 10% palladium on carbon as catalyst in n-hexane as solvent followed by filtration and stripping of solvent resulted in a hydrogenated oligomerized butadiene exhibiting a boiling range of 400° to 444° C., SUS viscosity of 162 at 37.8° C. and 45 at 99° C., a viscosity index of 118 and the following component distribution (determined by gas-liquid chromatography).

| Component | Wt. % |
|---|---|
| $C_{12}$ | 0.3 |
| $C_{16}$ | 0.1 |
| $C_{20}$ | 1.1 |
| $C_{24}$ | 7.1 |
| $C_{28}$ | 27.0 |
| $C_{32}$ | 33.6 |
| $C_{36+}$ | 30.8 |

Synthetic lubricating oil B employed in following runs 5–7 was prepared as described for oil A except that after the oligomerization reaction mixture was hydrogenated over the oligomerization catalyst, the hydrogenated material was fractionally distilled at reduced pressure to give oil B, a fraction boiling in the range 390°–510° C. (corrected at atmospheric pressure) with the following component distribution.

| Component | Wt. % |
|---|---|
| $C_8$—$C_{12}$ | 0.1 |
| $C_{16}$ | 0.2 |
| $C_{20}$ | 6.9 |
| $C_{24}$ | 22.3 |
| $C_{28}$ | 34.7 |
| $C_{32}$ | 17.0 |
| $C_{36}$ | 13.1 |
| $C_{40}$ | 5.8 |

Synthetic lubricating oil C employed in following runs 8–9 was prepared by oligomerizing butadiene in the presence of cobalt octanoate reduced in triethylaluminum as catalyst and a hydrogenated butadiene oligomer lubricating oil fraction such as oil A as diluent followed by preliminary treatment of the reaction mixture with hydrogen then followed by washing with acetic acid and water, filtration and fractional distillation to give a fraction boiling at 405° to 515° C. (corrected to atmospheric pressure) and then further hydrogenation of that fraction in the presence of n-hexane as solvent and 10% palladium on carbon as catalyst. After filtration and stripping of solvent, the hydrogenated butadiene oligomer (boiling range 405°–515°C.) exhibited SUS viscosities of 123 at 38° C. and 42 at 99° C., viscosity index of 112 and the following component proportions:

| Component | Wt. % |
|---|---|
| $C_{20}$ | 1.5 |

-continued

| Component | Wt. % |
|---|---|
| $C_{24}$ | 7.2 |
| $C_{28-40}$ | 91.3 |

The above-described synthetic lubricating oils were blended with the above-described calcium petroleum sulfonate mixture, overbased calcium petroleum sulfonate mixture, and/or propane-fractionated Mid-Continent lubricating oil fraction (about 96–98 SUS viscosity at 37.5° C. and a viscosity index of about 95) as added diluent oil to determine the effect on pour point of the synthetic lubricating oils. In Table I are recorded comparative and inventive formulations and pour points.

TABLE I

| Run No. | Synthetic Oil | Added Diluent Oil, Wt. % | CPS[a], Wt. % | OBCPS[b], Wt. % | Pour Point, 20°F.[c] |
|---|---|---|---|---|---|
| 1 (Comp.) | A | 0 | 0 | 0 | −40 |
| 2 (Comp.) | A | 1.5 | 0 | 0 | −40 |
| 3 (Inv.) | A | 1.5 | 0 | 0.5 | <−60 |
| 4 (Inv.) | A | 0 | 0 | 2.0 | <−60 |
| 5 (Comp.) | B | 0 | 0 | 0 | −30 |
| 6 (Inv.) | B | 0.5 | 0.5 | 0 | −35 |
| 7 (Inv.) | B | 0 | 0 | 1.0 | −40 |
| 8 (Comp.) | C | 0 | 0 | 0 | −25 |
| 9 (Inv.) | C | 0.5 | 0.5 | 0 | −40 |

[a]CPS = Calcium petroleum sulfonate mixture described above.
[b]OBCPS = Overbased calcium petroleum sulfonate mixture described above.
[c]ASTM D97.

The above results show that the addition of calcium petroleum sulfonate mixture (Runs 6 and 9) or overbased calcium petroleum sulfonate mixture (Runs 3, 4 and 7) to a hydrogenated oligomerized butadiene resulted in lower pour point for the formulation than the base hydrogenated oligomer.

EXAMPLE II

The following run illustrates the use of hydrogenated oligomerized butadiene (synthetic lubricating oil B from Example I) and overbased calcium petroleum sulfonate mixture (from Example I) in a fully formulated lubricating oil.

| Recipe | Wt. % |
|---|---|
| Synthetic lubricating oil B | 84.75 |
| Overbased calcium petroleum sulfonate mixture | 1.7 |
| High temperature detergent[a] | 1.5 |
| Dispersant[b] | 5.0 |
| Antioxidant/antiwear agent[c] | 1.22 |
| Viscosity index improver[d] | 5.83 |

[a]E-686 from Edwin Cooper & Co., Ltd.
[b]L-934 from Lubrizol Corp.
[c]L-1395 from Lubrizol Corp.
[d]Acryloid 703 from Rohm and Haas Co.

The pour point of the above formulation was −60° F. compared to −30° F. for synthetic lubricating oil B (see Run 5 above)

The foregoing examples demonstrate that the incorporation into the hydrogenated oligomer of the invention of a calcium petroleum sulfonate, as herein described, yields a composition having an unexpectedly, considerably lower pour point than that possessed by the oligomer alone.

Reasonable variation and modification are possible in the scope of the foregoing disclosure and the appended claims to the invention the essence of which is that compositions having significantly low pour points have been prepared by incorporating together a hydrogenated oligomer of a 1,3-diolefin, as herein described together with a calcium petroleum sulfonate also as herein described.

I claim:

1. A lubricating composition comprising a major amount of a synthetic lubricating oil essentially consisting of a hydrogenated oligomer of a 1,3-diolefin and a minor pour point depressant amount of at least one of a neutral and an overbased calcium petroleum sulfonate.

2. A composition according to claim 1 wherein the 1,3-diene is one having 4–8 carbon atoms.

3. A composition according to claim 1 wherein the synthetic lubricating oil is derived from at least one of 1,3-butadiene, piperylene, isoprene, 1,3-hexadiene, and 1,3-octadiene.

4. A composition according to claim 1 wherein the oligomer contains from about 12 to about 50 carbon atoms.

5. A composition according to claim 1 wherein the oligomer contains from about 20 to about 40 carbon atoms.

6. A composition according to claim 1 wherein the oligomer has the following component distribution as determined by gas-liquid chromatography:

| Component | Wt. % |
|---|---|
| $C_{12}$ | 0.3 |
| $C_{16}$ | 0.1 |
| $C_{20}$ | 1.1 |
| $C_{24}$ | 7.1 |
| $C_{28}$ | 27.0 |
| $C_{32}$ | 33.6 |
| $C_{36+}$ | 30.8 |

7. A composition according to claim 1 wherein the oligomer is a material obtained by fractional distillation at reduced pressure and boiling in the range of from about 390°–510° C., corrected to atmospheric pressure, and has the following component distribution:

| Component | Wt. % |
|---|---|
| $C_8$—$C_{12}$ | 0.1 |
| $C_{16}$ | 0.2 |
| $C_{20}$ | 6.9 |
| $C_{24}$ | 22.3 |
| $C_{28}$ | 34.7 |
| $C_{32}$ | 17.0 |
| $C_{36}$ | 13.1 |
| $C_{40}$ | 5.8 |

* * * * *